United States Patent [19]

Coordes et al.

[11] 4,432,536

[45] Feb. 21, 1984

[54] MOLTEN IRON CONTAINING VESSEL WITH IMPROVED REFRACTORY LINING

[75] Inventors: Heinz Coordes, Duisburg; Manfred Oberbach, Krefeld-Vergerg, both of Fed. Rep. of Germany

[73] Assignee: Didier-Werke AG, Wiesbaden, Fed. Rep. of Germany

[21] Appl. No.: 363,499

[22] Filed: Mar. 30, 1982

[30] Foreign Application Priority Data

Apr. 8, 1981 [DE] Fed. Rep. of Germany ..... 3114069

[51] Int. Cl.[3] ..... C21B 5/00

[52] U.S. Cl. ..... 266/280; 266/217

[58] Field of Search ..... 266/280, 286, 171, 197, 266/217; 148/133; 75/84

[56] References Cited

U.S. PATENT DOCUMENTS 3,148,238 9/1964 Willenbrock ..... 266/280

3,258,257 6/1966 Wilson et al. ..... 266/280 X 3,416,779 12/1968 Campbell ..... 266/280 X

OTHER PUBLICATIONS

"Refractory Materials–Their Manufacture and Uses"; Searle, pp. 500–501, 1950, Griffin & Co. London.

*Primary Examiner*—G. Ozaki

*Assistant Examiner*—David A. Hey

*Attorney, Agent, or Firm*—Wenderoth, Lind & Ponack

[57] ABSTRACT

A molten iron containing vessel includes a refractory fireproof inner lining of dolomite bricks and bauxite bricks. The lining includes magnesia bricks positioned between the dolomite and bauxite bricks, thereby avoiding contact reactions between the dolomite and bauxite. A gas permeable brick member extends through an end portion of the vessel for injecting a gas into the molten iron contained therein.

11 Claims, 1 Drawing Figure

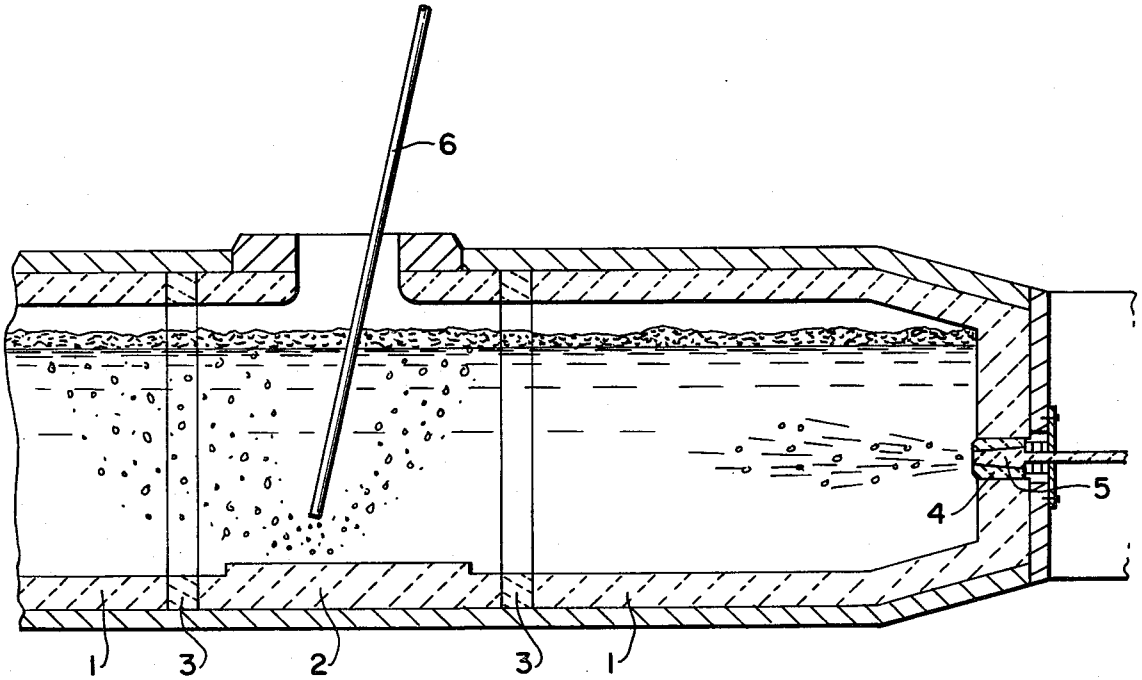
5
4
1
3
6
2
3
1

MOLTEN IRON CONTAINING VESSEL WITH IMPROVED REFRACTORY LINING

BACKGROUND OF THE INVENTION

The present invention relates to a molten iron containing vessel with an improved inner refractory lining. The present invention is particularly directed to such an improved vessel of the type employed for transporting and desulfurizing pig iron.

More specifically, this type of vessel or container may include a pipe or tubular area or portion, an end area or portion facing the tubular portion, and a gate or runner area or portion through which iron may be charged into the interior of the vessel. A refractory fireproof inner lining is provided on the interior of such vessel. In this type of vessel, the inner refractory lining may include dolomite bricks, particularly tar bonded dolomite bricks, in the tubular and end areas of the lining.

Chamotte bricks, high alumina content bricks such as bauxite, mullite and corundum bricks, as well as more basic bricks such as dolomite, magnesia and magnesia-chrome bricks are used for the inner lining of this type of container, which conventionally is operated at temperatures of approximately 1400° to 1600° C. For desulfurization of pig iron inside such a vessel, tar bonded, tempered dolomite bricks are recommended. For other situations however, bauxite bricks are recommended (C. Müller: Present Developments in the Lining for Transfer Ladles, "Sprechsaal 1976," a discussion corner in a magazine, pp. 156 to 161, and H. Höfges et al.: Operational Experience with Transfer Ladles with Linings made of Chamotte, High Alumina Cement, Magensite and Dolomite, XVIII International Fireproof Colloquy in Aachen, October 1975; a collection of lectures, pp. 84 to 100).

When the refractory lining is constructed of relatively inexpensive dolomite bricks, slag which develops during the desulfurization process is easily deposited on the lining, particularly in the lower part of the end portion of the vessel. This leads to a reduction of the interior volume of the vessel. Unlike dolomite bricks, bauxite bricks have a much higher durability and resistance to erosion, and therefore are of interest for the charging or gate portion of the lining. Thus, it has become the practice to employ a combination of the two types of bricks, i.e. bauxite bricks in the gate portion of the lining, and dolomite bricks in the tubular and end portions of the lining. Such a lining construction however causes a weakening of the brickwork in the areas where the two types of bricks join, due to contact reactions between the two types of materials. Also, there results an undesirably heavy formation of slag in the end portion or area of the vessel.

SUMMARY OF THE INVENTION

With the above discussion in mind, it is an object of the present invention to provide an improved vessel of the type discussed, which is capable of operating in the intended manner, but whereby it is possible to overcome the prior art disadvantage of weakening of the brickwork of the lining in the areas between the two types of brick, and whereby to avoid undesirably heavy formation of slag in the end portion of the vessel.

This object is achieved in accordance with the present invention by the provision of a vessel for containing therein molten iron, for example a vessel for transporting pig iron and for use in desulfurization of pig iron. The vessel includes an elongated portion, for example a tubular or pipe portion, an end portion facing the elongated portion, and a gate or runner portion between the tubular and end portions. Iron may be charged into the vessel through an opening in the gate portion. The vessel includes a refractory fireproof inner lining. In accordance with the present invention, this lining is dolomite, for example dolomite bricks, in the tubular and end portions and is bauxite, for example bauxite bricks, in the gate portion. In accordance with the present invention, the lining includes magnesia bricks provided between adjacent areas of the dolomite and bauxite. This type of inner lining avoids weakening of the brickwork of the lining due to reactions between adjoining brick types, since the magnesia does not react with the dolomite or with the bauxite.

Additionally in accordance with the present invention, there is provided a gas permeable brick or stone member which extends through the end portion of the vessel into the interior of the vessel. A scavenging, flushing or rinsing gas may be injected into the molten iron within the interior of the vessel through the gas permeable brick member. The gas permeable brick member may be of known construction and of the type capable of injecting a gas into the interior of molten metal within a vessel. The injection of a flushing or scavenging gas into the melt, through the gas permeable brick member in the end portion of the vessel, causes an intensive mixing of the molten melt. This is advantageous with respect to the desulfurization operation. Additionally however, and surprisingly, it has been determined that the injection of such gas reduces the formation of and/or protects the lining from slag. Even if some slag formation still occurs within the container, a noticeable decrease in the formation of slag or even a reduction of existing slag becomes obvious after a number of subsequent operations of the vessel.

In accordance with a variation of the present invention, from one to three rings of magnesia bricks or stones may be arranged in the vessel, for example in the tubular portion of the lining of the vessel.

Preferably, the magnesia bricks should have a MgO content of at least 93% by weight and a $CaO:SiO_2$ ratio of 1.8 to 2.8. Such magnesia bricks may directly border on the dolomite and bauxite, without the provision of any refractory mortar therebetween. Also, fired, carbonaceous and tar bound magnesia bricks or stones could be employed.

The gas permeable brick member, which may be termed a "flushing stone" preferably consists of a refractory material having a high alumina content e.g. on the basis of fireclay, mullit, sintered alumina. The gas permeable brick member, particularly when formed of a material having a high alumina content, may be surrounded by a layer of magnesia bricks or stones, thereby shielding the gas permeable brick member from the dolomite.

Preferably, the dolomite is in the form of tar bonded and tempered dolomite bricks.

BRIEF DESCRIPTION OF THE DRAWING

Other objects, features and advantages will be apparent from the following detailed description of a preferred embodiment of the present invention, with reference to the drawing, wherein:

The single FIGURE is a somewhat schematic cross sectional view of a vessel incorporating the present invention.

DETAILED DESCRIPTION OF THE INVENTION

In the single drawing FIGURE there is illustrated a vessel according to the present invention, specifically a vessel for the transportation of pig iron and for use in a desulfurization operation. The vessel contains a refractory fireproof inner lining. This lining, in the elongated or tubular and in the end portions thereof is in the form of dolomite, for example dolomite bricks 1. This lining in the area of the gate or runner portion of the container is in the form of bauxite, for example bauxite bricks 2.

In accordance with the present invention, between adjacent portions of the dolomite bricks 1 and the bauxite bricks 2 there is provided a ring layer of magnesia bricks 3. Thus, magnesia bricks 3 are provided on opposite end portions of the bauxite portion 2 of the lining. The provision of the magnesia bricks between adjacent portions of the dolomite bricks 1 and the bauxite bricks 2 prevents contact reactions which otherwise would occur between the dolomite and bauxite, thereby preventing weakening of the lining structure.

In accordance with a further feature of the present invention, a gas permeable brick member 5 extends through the end portion into the interior of the vessel. A scavenging, flushing or rinsing gas (argon or nitrogen) may be injected into the iron melt within the vessel through gas permeable brick member 5. Brick member 5 may be of a structure and composition known in the art for injecting a gas through a vessel into a molten melt therein. A layer or ring of magnesia bricks or stones 4 may support brick member 5. This is particularly advantageous when the brick member 5 is formed of a refractory material having a high alumina content, thereby separating the high alumina content brick member from the dolomite of the adjacent lining.

Desulfurization is achieved in a conventional manner with the aid of lance 6, and during such operation the interior of the vessel is filled with molten pig iron and slag.

The flushing, rinsing or scavenging gas injected through brick member 5 favorably influences the desulfurization operation and protects against the accummulation of slag in the bottom of the end portion. Additionally, it surprisingly has been discovered that the injection of the gas through brick member 5 also reduces the formation of slag.

It is to be understood that the compositions of dolomite bricks 1 and bauxite bricks 2 are conventional in the art, bauxite bricks 2 providing erosion resistance in the charging area.

Although the present invention has been described and illustrated with respect to preferred features thereof, it is to be understood that various modifications may be made to the specifically described and illustrated features without departing from the scope of the present invention.

We claim:

1. In a horizontal vessel for transporting and desulfurizing pig iron, said vessel being of the type including a horizontally elongated tubular portion, an end portion facing and closing the tubular portion, and a gate portion between said tubular and end portions and having an upper opening through which pig iron may be charged into said vessel, and a refractory fireproof inner lining, the improvement wherein:

said lining in said tubular and end portions comprises dolomite;

said lining in said gate portion comprises bauxite;

said lining includes magnesia bricks between said dolomite and bauxite; and means for injecting a flushing gas into said end portion of said vessel and thereby for reducing slag therein, said injecting means comprising a gas permeable brick member extending through said end portion into the interior of said vessel.

2. The improvement claimed in claim 1, comprising three rings of said magnesia bricks.

3. The improvement claimed in claim 1, wherein said magnesia bricks are provided in said tubular portion.

4. The improvement claimed in claim 1, wherein said magnesia bricks are provided at opposite ends of said bauxite.

5. The improvement claimed in claim 1, wherein said dolomite comprises dolomite bricks.

6. The improvement claimed in claim 5, wherein said dolomite bricks comprise tar bound, tempered dolomite bricks.

7. The improvement claimed in claim 1, wherein said bauxite comprises bauxite bricks.

8. The improvement claimed in claim 1, wherein said magnesia bricks have a MgO content of at least 93% by weight and a $CaO:SiO_2$ ratio of 1.8 to 2.8.

9. The improvement claimed in claim 1, wherein said magnesia bricks directly border on said dolomite and bauxite, wherein the interposition therebetween of refractory mortar.

10. The improvement claimed in claim 1, wherein said gas permeable brick member is formed of a material having a high alumina content.

11. The improvement claimed in claims 1 or 10, wherein said gas permeable brick member is surrounded by a layer of magnesia bricks.

* * * * *